United States Patent [19]

Antone

[11] 3,993,040

[45] Nov. 23, 1976

[54] WOOD BURNING STOVE

[76] Inventor: Lawrence J. Antone, Star Route, Dalton, Mass. 01226

[22] Filed: Feb. 6, 1975

[21] Appl. No.: 547,566

[52] U.S. Cl. ..... 126/60; 126/217; 220/334

[51] Int. Cl.[2] ..... F24C 1/00

[58] Field of Search ..... 126/58, 60, 65, 217, 126/220, 202; 220/334

[56] References Cited

UNITED STATES PATENTS

| | | | |
|---|---|---|---|
| 6,499 | 6/1849 | Brown | 126/58 X |
| 9,801 | 6/1836 | Atwater | 126/58 |
| 188,475 | 3/1877 | Martin | 126/65 X |
| 1,357,432 | 11/1920 | Abernathy | 126/202 |
| 1,445,816 | 2/1923 | Bailey | 220/334 X |

*Primary Examiner*—William F. O'Dea
*Assistant Examiner*—William E. Tapolcai, Jr.
*Attorney, Agent, or Firm*—Leonard Weiss

[57] ABSTRACT

A fuel insertion door forms a portion of the top of a fire box of a wood burning stove. The stove additionally includes a viewing door which closes to cover an opening in the front of the fire box. When the fuel insertion door is closed, a tab extending therefrom overhangs the front of the fire box to maintain a closure of the viewing door.

1 Claim, 2 Drawing Figures

WOOD BURNING STOVE

BACKGROUND OF THE INVENTION

1. Field of the Invention

This invention relates to stoves and more particularly is a stove which provides a view of flames of a fire burning therein.

2. Description of the Prior Art

Recently there has been an increase in the cost of energy derived from oil and coal. Because of the increase, in a wooded area a home owner may desire a wood burning stove to provide heat.

When the stove is in the home, typically the stove's decorative aspects are regarded as being as important as the providing of the heat. An often desired decorative aspect is a view of flames of a fire burning within the stove. Therefore, the home owner may want the stove to have features operable to safely provide the view of the flames.

In the prior art a plethora of wood burning stoves include a door which may either be closed to cover an opening in a fire box or opened to provide a view of the flames through the opening. Typically, the door is neither easily closed nor easily opened. Additionally, the door may be ajar and appear to the home owner to be closed, thereby causing a fire hazard. Therefore, the stoves of the prior art do not have the features referred to hereinbefore.

Accordingly, there is a need for a stove where the door is easily and safely closed and opened with a closure being easily discernible.

SUMMARY OF THE INVENTION

An object of the present invention is to provide a view of flames of a fire within a wood burning stove.

Another object of the invention is to provide a wood burning stove having a viewing door which is easily closed and opened whereby flames of a fire burning therein may be viewed through an opening in the stove when the viewing door is open.

Another object of the invention is to provide a stove having a viewing door which is easily closed and opened with a closure of the viewing door being easily discernible.

According to the present invention, the fire box of a stove has a top which includes a fuel insertion door having a part which overhangs the front of said fire box when said fuel insertion door is closed, said overhanging part being operable to maintain a closure of a viewing door thereby covering an opening in said fire box.

A wood burning stove constructed according to the invention has a fire box with an opening therein which is covered when a viewing door is closed, a closure of the viewing door being easily discernible.

Other objects, features and advantages of the present invention will become more apparent in the light of the following description of the preferred embodiment thereof as illustrated in the accompanying drawing.

DESCRIPTION OF THE PREFERRED EMBODIMENT

Figure 1:
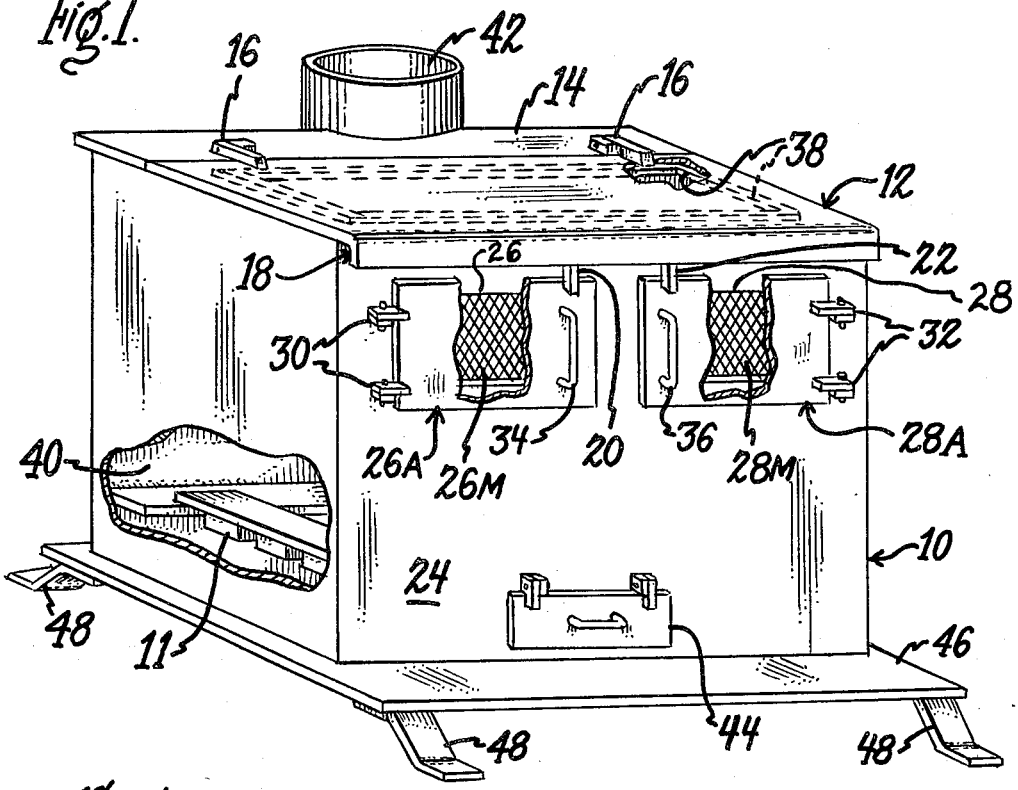
FIG. 1 is a perspective view, with parts broken away, of a preferred embodiment of the present invention.
Figure 2:
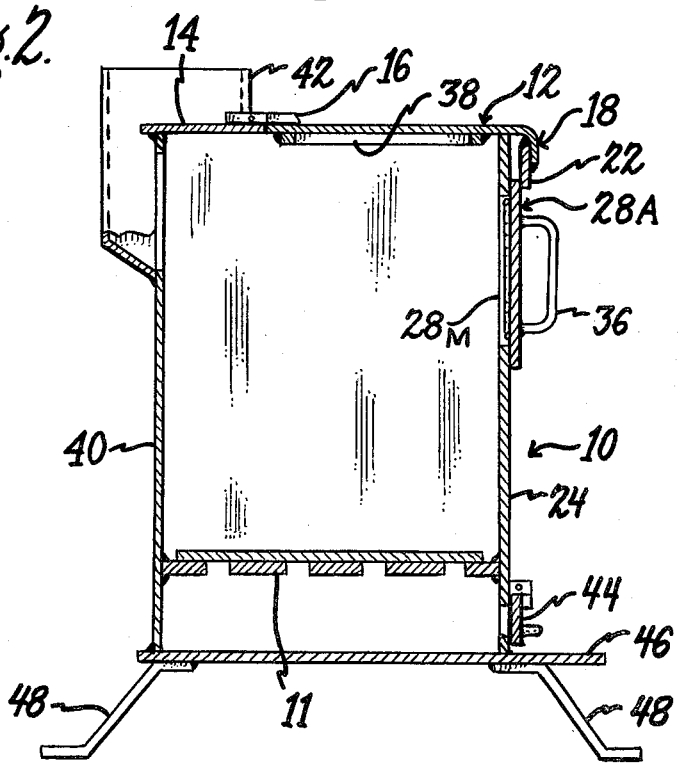
FIG. 2 is a section of a side elevation of the embodiment of FIG. 1.

Referring to FIG. 1 and FIG. 2, a wood burning stove is comprised of a metal fire box 10 having a top which includes a fuel insertion door 12. The door 12 is rotatably connected to a stationary lid 14 via a pair of hinges 16 whereby the door 12 is rotated to provide either an opening or a closure thereof. The door 12 is typically opened either for depositing wood (or any other suitable fuel) within the fire box 10 or for opening and closing a viewing door as explained hereinafter. Connected within the fire box 10, near the bottom thereof, is a grate 11 upon which the wood is deposited.

The door 12 has a lip 18 which includes tabs 20, 22. When the door 12 is closed, the tabs 20, 22 overhang a front portion 24 of the fire box 10. As explained hereinafter, the distal end of a tab may maintain a closure of a viewing door.

In the front 24 a pair of openings 26, 28 are disposed above the gate 11 thereby providing a vertical displacement of the openings 26, 28 from the grate 11. Near the openings 26, 28 are doors 26A, 28A rotatably connected to the front 24 via pairs of hinges 30, 32, respectively, whereby the doors 26A, 28A may each be rotated to provide either an opening or a closure thereof. The doors 26A, 28A close to cover the openings 26, 28, respectively. Therefore, when the doors 26A, 28A are open, there is provided through the openings 26, 28 a view of flames of a fire caused by the wood burning within the fire box 10.

Preferably, the vertical displacement of the openings 26, 28 is greater than 3 inches. Because of the vertical displacement, the burning wood is safely retained below the openings 26, 28 (on the grate 11) when the flames are being viewed.

When the doors 12, 26A, 28A are closed, the distal ends of the tabs 20, 22 extend over the doors 26A, 28A, respectively, whereby the tab 20 maintains a closure of the door 26A and the tab 22 maintains a closure of the door 28A. When the door 12 is open, the door 26A may be opened while the door 28A remains closed or vice versa. Thereafter, when the door 12 is closed, the closure of a viewing door is maintained by a tab as explained hereinbefore. Because a tab extends over a viewing door when a closure is maintained, a closure is easily discernible.

When the door 12 is open, the doors 26A, 28A may be opened and remain open when the door 12 is thereafter closed. Handles 34, 36 are respectively connected to the doors 26A, 28A to facilitate a manual opening and closure thereof.

In an alternative embodiment where tabs are not used, a lip of a fuel insertion door overhangs the front of a fire box to maintain a closure in a manner similar to the tabs 20, 22 of the preferred embodiment.

In the preferred embodiment the openings 26, 28 are covered with decorative wire mesh 26M, 28M, respectively, connected to the inside of the fire box 10. The mesh 26M, 28M inhibits cinders from being propelled from the inside to the outside of the fire box 10 from the burning wood when either or both of the doors 26A, 28A are open.

Typically, when the door 12 is closed, near the edges thereof is a narrow space through which cinders may be propelled from the burning wood to the outside of the fire box 10. In the preferred embodiment, metal bars 38 are connected to the door 12 adjacent to the edges by welding or in any other suitable manner. The bars 38 deflect cinders from the burning wood which are propelled towards the narrow space.

The lid 14 and a rear portion 40 of the fire box 10 are connected to a chimney 42 which extends into the fire box 10. As well known to those skilled in the art, the chimney 42 forms a passageway from the inside to the outside of the fire box 10 thereby providing an outlet for smoke from the burning wood.

The front 24 additionally has connected thereto a door 44 which closes to cover a damper opening in the front 24. The door 44 is typically opened either to provide a flow of air into the fire box 10 for supporting the burning of the wood or providing access to the bottom of the fire box 10 whereby ashes may be removed therefrom.

In this embodiment, the fire box 10 includes a bottom plate 46 which is supported above a floor by a plurality of legs 48. It should be understood that in an alternative embodiment a fire box may be supported in any suitable manner.

Thus there is described hereinbefore a wood burning stove where a closure of a viewing door is maintained by a tab which is a part of a fuel insertion door.

Although the invention has been shown and described with respect to a preferred embodiment thereof, it should be understood by those skilled in the art that various changes and omissions in the form and detail thereof may be made therein without departing from the spirit and the scope of the invention.

Having thus described a typical embodiment of my invention, that which I claim as new and desire to secure by Letters Patent of the United States is:

1. A wood burning stove having a fire box adapted to receive a fuel which is burned therein, the improvement comprising:

a fuel insertion door which forms a portion of the top of said fire box, a part of said fuel insertion door overhanging the front of said fire box when said fuel insertion door is closed;

a viewing door connected to said fire box which closes to cover an opening in said fire box, a closure of said viewing door being maintained by said overhanging part; and a metal bar connected to the inside of said fuel insertion door adjacent to an edge thereof whereby said bar deflects cinders propelled from said burning fuel toward said edge when said insertion door is closed.

* * * * *